United States Patent [19]

Cheng

[11] Patent Number: 5,023,118

[45] Date of Patent: Jun. 11, 1991

[54] ARTIFICIAL FLOWER WITH INFLATABLE PETALS AND/OR INFLATABLE MULTIPLE PETAL ASSEMBLIES

[76] Inventor: Peter S. C. Cheng, 5 Ross Street, Toronto, Ontario, Canada, M5T 1Z8

[21] Appl. No.: 536,702

[22] Filed: Jun. 12, 1990

[51] Int. Cl.[5] ..... A41G 1/00

[52] U.S. Cl. ..... 428/24; 156/61; 244/31; 428/12; 446/221

[58] Field of Search ..... 446/220, 221, 222; 428/12, 16, 24–26; 244/31; 156/61

[56] References Cited

U.S. PATENT DOCUMENTS

| | | | |
|---|---|---|---|
| 1,610,156 | 12/1926 | Riley et al. | 156/61 |
| 2,053,371 | 9/1936 | Lee | 156/61 |
| 2,684,923 | 7/1954 | Harrison | 156/61 |
| 2,922,252 | 1/1960 | Van Dam et al. | 428/12 X |
| 3,835,308 | 9/1974 | Reese | 428/16 X |
| 4,077,588 | 3/1978 | Hurst | 428/16 X |
| 4,226,902 | 10/1980 | Webb | 446/220 X |
| 4,850,926 | 7/1989 | Lovik | 446/222 |

*Primary Examiner*—Henry F. Epstein

*Attorney, Agent, or Firm*—Kirschstein, Ottinger, Israel & Schiffmiller

[57] ABSTRACT

An artificial inflated flower composed of individual inflated petals and/or petal assemblies. Selected portions of the petals and petal assemblies are sealed together along heat-fused seams to impart a generally flattened shape to each petal and assembly.

37 Claims, 3 Drawing Sheets

ARTIFICIAL FLOWER WITH INFLATABLE PETALS AND/OR INFLATABLE MULTIPLE PETAL ASSEMBLIES

BACKGROUND OF THE INVENTION

1. Field of the Invention

This invention generally relates to artificial flowers and, more particularly, to such flowers comprised of a plurality of inflatable petals and/or inflatable multiple petal assemblies.

2. Description of Related Art

The beauty of real flowers has often been captured by artificial flowers made of such materials as silk, paper, glass, plastic, chocolate and the like. Sometimes, a plurality of tethered balloons made either of air-filled elastomeric envelopes or of helium-filled foil-seal-type envelopes are gathered in a bunch in an effort to simulate an artificial flower. However, such gas-filled envelopes have a generally spherical configuration and do not realistically duplicate the appearance of a flower. Also, gas-filled envelopes, particularly when made of elastomeric material such as rubber, have a limited lifetime as a result of gas diffusion through the rubber material. Such drawbacks have led away from the use of inflatable materials in the construction of artificial flowers.

SUMMARY OF THE INVENTION

1. Objects of the Invention

It is a general object of this invention to provide an artificial flower constructed of inflatable materials.

It is another object of this invention to provide such a flower which is attractive in appearance, long lasting in use, inexpensive to manufacture, and durable in construction.

Another object of this invention is to provide an inflatable artificial petal and an inflatable artificial multiple petal assembly, either or both of which can be used to simulate a real flower.

2. Features of the Invention

In keeping with these objects, and others which will become apparent hereinafter, one feature of this invention resides, briefly stated, in an artificial flower comprised of a plurality of inflatable artificial petals and/or inflatable artificial petal assemblies. The petals and/or petal assemblies are gathered in a corola-like configuration.

Each petal comprises an elongated envelope extending along a longitudinal direction and having a periphery. The envelope includes a pair of overlying panels sealed together along the periphery of the envelope and bounding an interior into which gas such as air or helium is introduced to inflate the petal.

Each panel has a neck portion and a head portion integral therewith. Each head portion has a larger transverse dimension as considered along a transverse direction generally perpendicular to the longitudinal direction, than the transverse dimension of the neck portion of the respective panel. Each neck and head portion of each panel has outwardly-flaring, longitudinally-extending side edges. The side edges of each neck portion merge continuously into the side edges of the head portion of the respective panel.

Selected portions of the panels within the periphery of the envelope are sealed together to impart a generally flattened shape to the inflated petal. These selected portions include a plurality of elongated seams, each extending at least partially along the longitudinal direction. The seams are spaced apart along the transverse direction to form tubular channels, all in gaseous communication with one another, within the interior of the envelope. The seams, in the preferred embodiment, extend at least partially along linear paths, and at least partially along curved paths. The seams are preferably heat-fused seals located in a common plane midway between the outwardly-facing surfaces of the panels. The seam cause the outwardly-facing surfaces of the panels to have a generally rippled contour over the inflated petal.

Preferably, each panel is a non-elastomeric polymer sheet coated with a continuous metallic coating. The metallic coatings of the overlying panels face each other and adhere to each other along the seams. The resultant envelope is thereby rendered substantially gas-impermeable and substantially permanently airtight.

At least one filling nozzle is provided on the envelope. The gas is introduced into the envelope through such filling nozzle. Once the filling is completed, the nozzle is closed, e.g. by a heat-fusion sealing process so as to prevent escape of the gas to the exterior atmosphere, or by a self-closing valve.

A plurality of such artificial inflated petals is gathered in a bunch and prevented from shifting longitudinally of one another by shoulder portions on the neck portion of each panel. Each shoulder portion has a larger transverse dimension than that of the neck portion of the respective panel. An elastic band, string or analogous gathering means gathers the petals in the aforementioned corola-like configuration.

Each multiple petal assembly comprises an envelope having a plurality of inflatable petals spaced apart of one another. Each adjacent pair of petals is foldable relative to a fold line between the petals of each pair.

The envelope includes a periphery and a pair of overlying panels sealed together along the periphery. Each panel of each petal has a neck portion and an enlarged head portion integral therewith. The panels of each petal together bound an interior compartment into which gas is introduced for containment therein. Each interior compartment is in gaseous communication with all the other interior compartments for inflating all of the petals of the assembly at the same time.

Selected portions of the panels are sealed together within the periphery of the envelope to impart a generally flattened shape to each inflated petal. As described above in connection with the individual petal, the petal assembly includes a plurality of elongated seams, each extending at least partially along a longitudinal direction. The seams are spaced apart along the transverse direction to form tubular channels within the interior compartment of each petal. The tubular channels of each petal are in gaseous communication with one another, preferably by means of an elongated common conduit between the petals of each pair. The petal assembly advantageously includes several, e.g. more than five, petals to reduce manufacturing costs.

As previously mentioned, the artificial flower may be comprised of many individual artificial petals, many multiple petal assemblies, or both. Each individual petal is foldable about each seam thereof, and each petal assembly is not only foldable about each seam thereof, but also about the fold line between the petals of each pair. Hence, the folded petals and petal assemblies may be conveniently gathered in the corola-like configuration to simulate an artificial flower. The generally flattened configuration of each petal more closely resembles a real petal of a flower than the generally spherical gas-filled envelopes of the prior art. The resultant inflated flower is attactive in appearance, long lasting in use, inexpensive to manufacture and durable in construction. The use of a non-elastomeric polymer sheet coated with a continuous metallic coating provides for a substantially air-tight envelope for long-term use.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
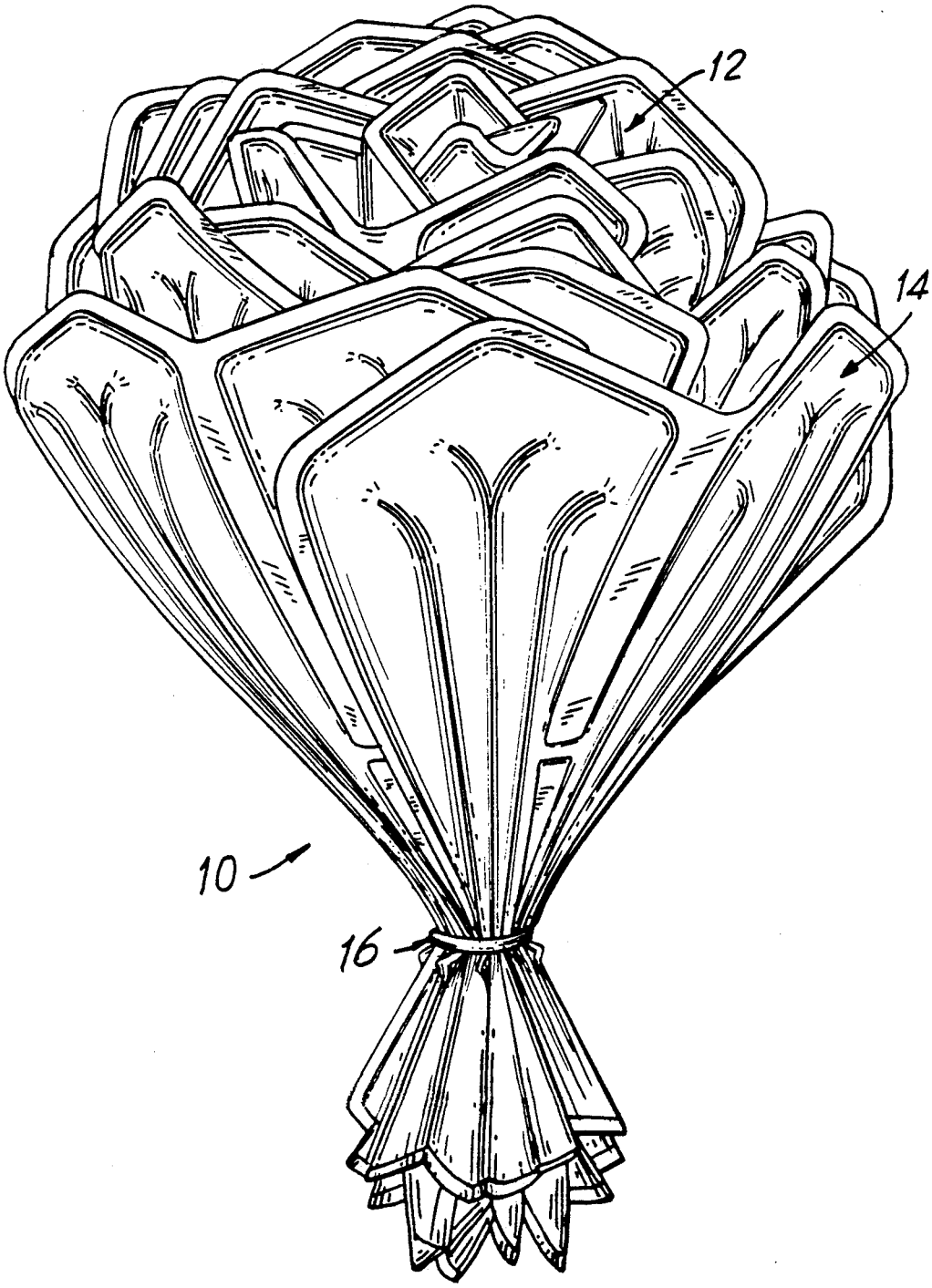
FIG. 1 is a front and top perspective view of an inflated artificial flower in accordance with this invention.

Referring now to FIG. 1 of the drawings, reference numeral 10 generally identifies an inflated artificial flower. Flower 10 may be comprised solely of a plurality of individual inflated artificial petals 12 (see FIG. 2), or solely of a plurality of inflated artificial petal assemblies, one of which is identified in FIG. 4 by reference numeral 14, or any desired combination of such individual petals 12 and petal assemblies 14. The petals 12 and petal assemblies 14 are gathered in a bunch and held together in a flower-like or corola-like configuration, as depicted in FIG. 1, by an annular elastic band 16. Alternately, a string or analogous ring-like fastener could be employed.

Figure 2:
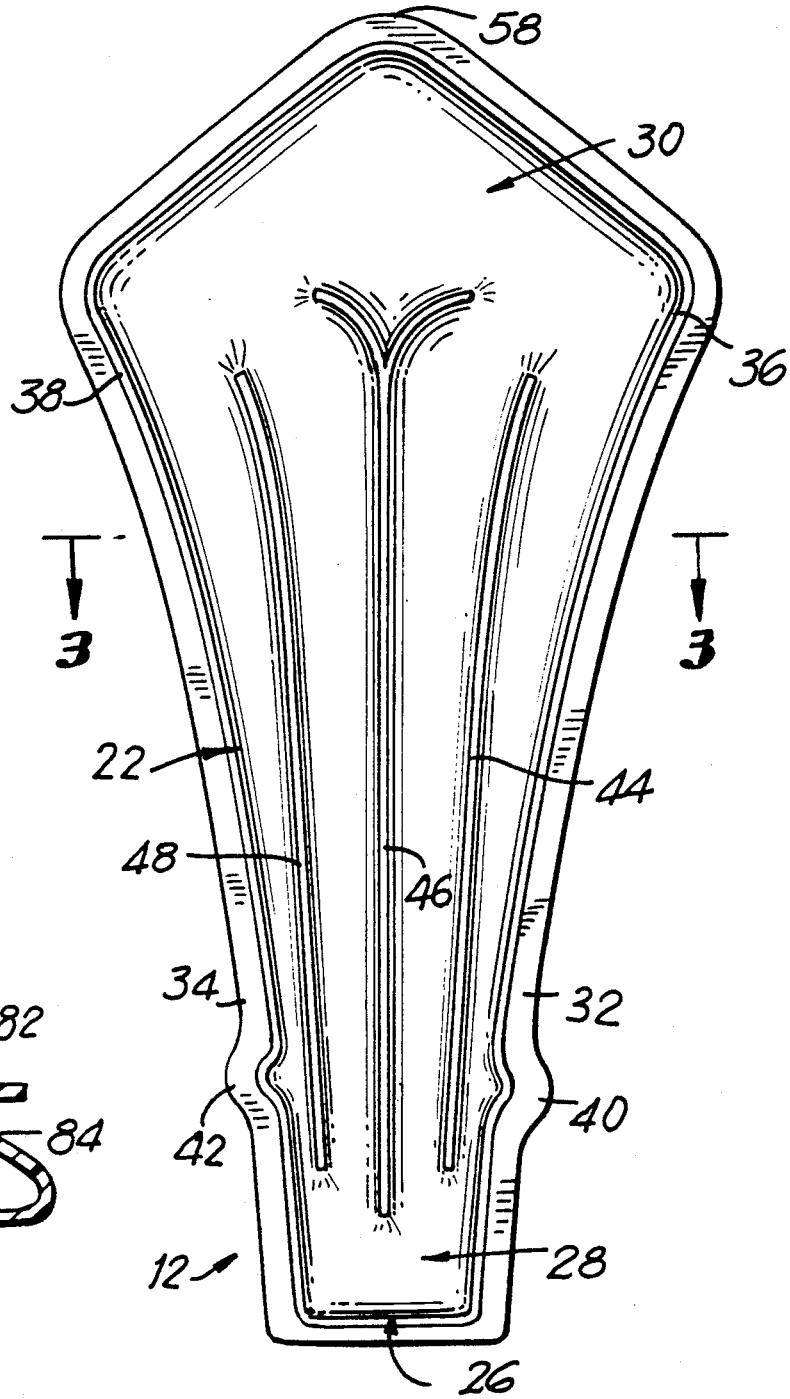
FIG. 2 is a front elevational view of an inflated artificial petal in accordance with this invention.
Figure 3:
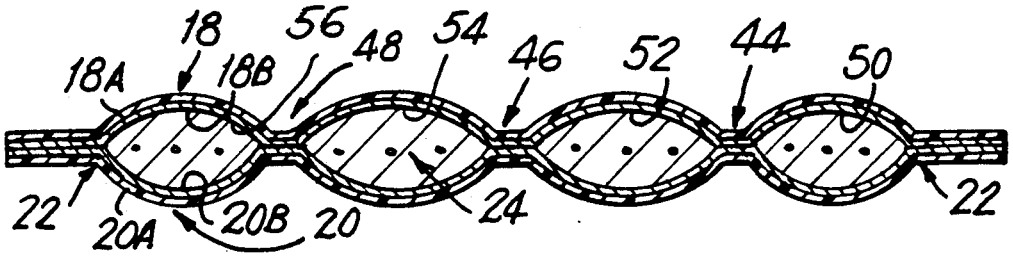
FIG. 3 is an enlarged sectional view taken on line 3—3 of FIG. 2.

Turning now to FIGS. 2 and 3, the petal 12 includes a pair of overlying panels 18, 20. Panels 18, 20 include non-elastometic polymer sheets 18A, 20A whose inner surfaces are coated with continuous metallic coatings 18B, 20B, respectively. The panels 18, 20 together constitute an elongated envelope which extends along a longitudinal direction and has a periphery. The panels 18, 20, as best shown in FIG. 2, are heat-sealed together along the periphery of the envelope along peripheral seam 22. The panels 18, 20 bound an interior into which a gas 24, such as air, helium or the like, is introduced to inflate the petal. At a convenient point on the envelope, for example, at lowermost end 26 of the envelope, a filling nozzle is provided. The gas 24 is introduced into the envelope through such filling nozzle 26. Once the filling is completed, the filling nozzle 26 is closed, for example, by heat-fusion sealing techniques, so as to prevent escape of the gas 24 to the exterior atmosphere.

Each panel has a neck portion 28 and an enlarged head portion 30 integral therewith. Each head portion 30 has a larger transverse dimension as considered along a transverse direction generally perpendicular to the longitudinal direction of the envelope than the transverse dimension of the neck portion of the respective panel. Each neck portion 28 has outwardly-flaring, longitudinally-extending side edges 32, 34. Each head portion 30 has outwardly-flaring, longitudinally-extending side edges 36, 38. The side edges 32, 34 of each neck portion merge continuously into the side edges 36, 38, respectively, of the head portion 30 of the respective panel.

Each panel 18, 20 also has shoulder portions 40, 42 extending away from each other along the transverse direction. Each shoulder portion 40, 42 has a larger transverse dimension that of the adjacent neck portion 28 of the respective panel.

In accordance with this invention, means are provided for sealing selected portions of the panels 18, 20 together within the peripheral seam 22 of the envelope to impart a generally flattened shape to the inflated petal. In a preferred embodiment, the sealing means seals the panels together along a plurality of elongated seams 44, 46, 48. Each seam extends at least partially along a linear path along the neck portion 28 of each petal, and also extends at least partially along outwardly-curved paths along the head portion 30 of each petal. The seams 44, 46, 48 are spaced apart along the transverse direction to form tubular channels 50, 52, 54, 56 within the interior of the envelope. The tubular channels are in constant gaseous communication with one another, preferably at both ends of each tubular channel. The polymer sheets 18A, 20A have outwardly-facing surfaces, and the seams 44, 46, 48 are located in a common plane midway between the outwardly-facing surfaces of the polymer sheets. When inflated, these outwardly-facing surfaces have a rippled appearance.

The resultant inflated petal depicted in FIG. 2 has a generally elongated, pentagonal, flattened configuration with a relatively long neck and a slightly-outwardly-bulging head or crown. The crown tapers inwardly and upwardly to a peak or top 58 which is opposite the filling nozzle 26. The envelope is foldable about any one or more of the seams 44, 46, 48.

Figure 4:
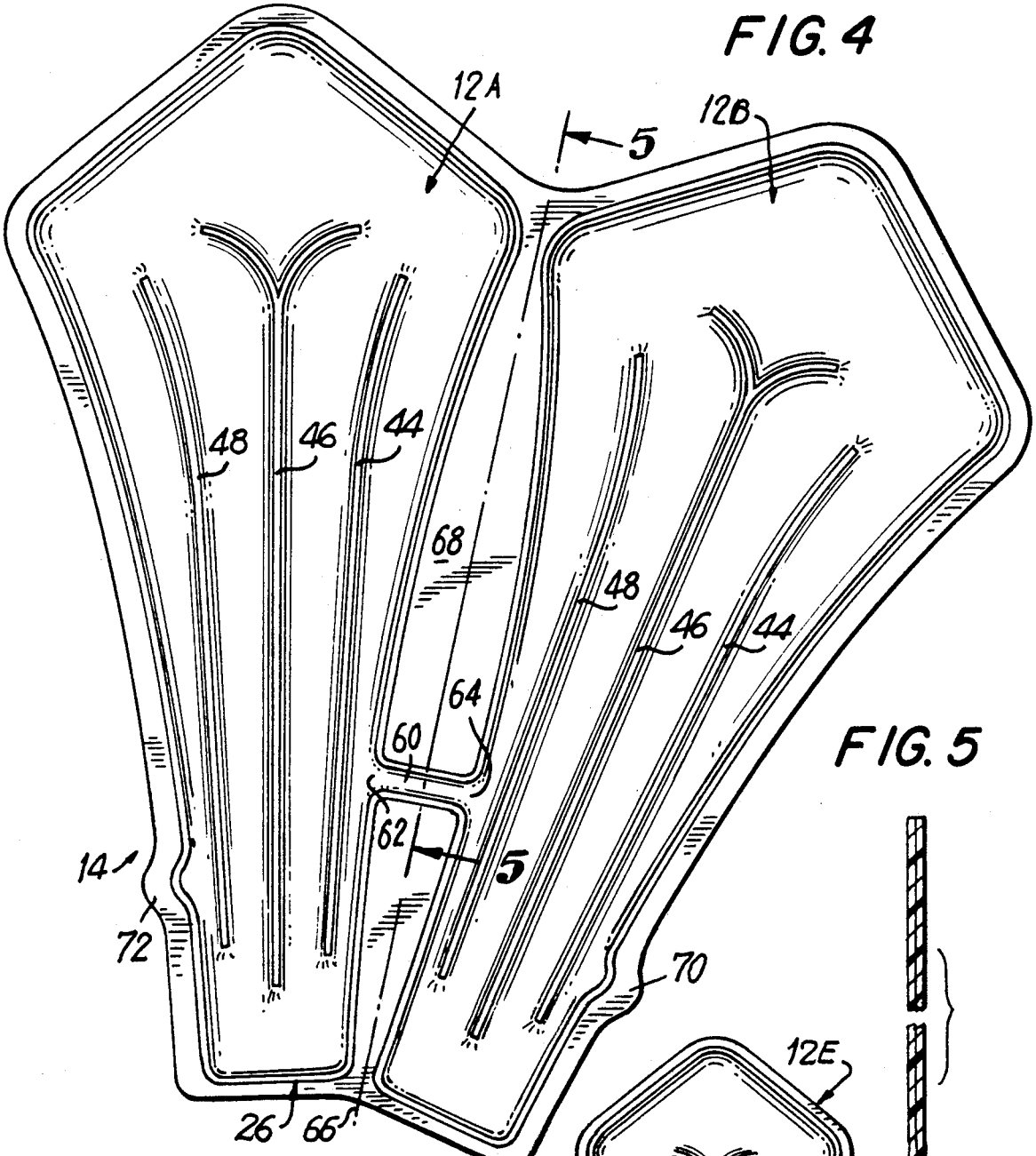
FIG. 4 is a front view of an inflated petal assembly in accordance with this invention.
Figure 5:
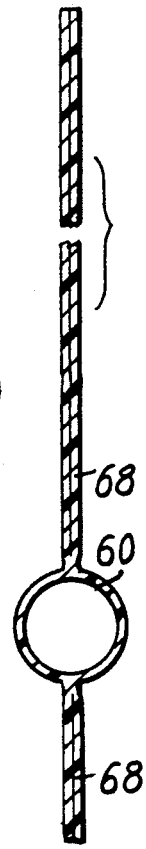
FIG. 5 is a sectional view taken on line 5—5 of FIG. 4.

Turning now to FIG. 4, the multiple petal assembly 14 essentially includes two or more inflatable petals 12A, 12B, as previously described. Although only two petals are shown in FIG. 4, this invention contemplates forming each assembly of any number of such petals to reduce manufacturing costs.

Petals 12A, 12B are interconnected by an elongated common conduit 60 having one end 62 in constant gaseous communication with the interior of the petal 12A, and an opposite end 64 in constant gaseous communication with the interior of inflated petal 12B. The petal assembly 14 need have only one filling nozzle 26 on petal 12A. When gas is introduced through nozzle 26, all of the petals are simultaneously inflated due to the connection of the conduit 60.

Petals 12A, 12B are mirror-symmetrically arranged relative to a fold line 66 between them. Petals 12A, 12B are interconnected by a common web 68 which is thin and flexible so as to permit folding about the fold line 66. Rather than providing shoulder portions 40, 42 for each petal, as illustrated in FIG. 2, shoulder portions 70, 72 are provided at opposite ends of the entire assembly 14. The seams 44, 46, 48 for each petal of the assembly 14 are identical in structure and function to those described earlier in connection with FIG. 2.

In use, either the folded petal 12 or the folded petal assemblies 14 or, advantageously, both, are gathered at their respective neck portions to form the flower-like configuration for the flower depicted in FIG. 1. The ring-like band 16 or holder is situated above, and engages, the shoulder portions 40, 42, 70, 72 of the petals and/or petal assemblies to insure that the petals and/or petal assemblies do not shift longitudinally relative to one another and, in fact, remain in place. The inflated flower may be presented as part of a bouquet.

Various sealing techniques may be employed to seal together the panels of each petal or petal assembly. It is currently preferred to use heat-sealing techniques such as jaw-type sealers, impulse-type sealers, hot-wire sealers, etc. In addition, ultrasonic sealing or light sealing, or any other radiant-energy sealing such as laser-energy sealing, dielectric sealing (electronic), induction bonding, or infrared bonding, may be used. Furthermore, other means of sealing the envelope panels can be utilized other than heat sealing, such as, for example, adhesive bonding, solvent sealing, extruded-bead sealing, and hot-melt sealing.

In an advantageous embodiment, each non-elastomeric polymer sheet is selected from polyolefins, polyvinyl chloride, polyesters, polyvinylidene chloride, polyvinyl alcohol, regenerated cellulose, polyurethane, ethylene vinyl acetate copolymer, ionomers, polyamides, and nitrile polymers.

Each metallic coating is continuous over and coextensive with the inner side of each sheet. Each metallic coating is opaque, and has a thickness in the range of from about $1\times10^{-6}$ inch to about $5\times10^{-5}$ inch. Each metallic coating is aluminum, but other malleable common metals such as copper, gold, silver, iron, chromium, nickel and the like could be employed. Aside from vapor deposition, the coating can be formed by vacuum metallizing, vapor-phase deposition, cathode sputtering, or even hand painting.

Rather than a single sheet and a single coating to constitute each panel, other laminate composite constructions may be employed such as a single coating sandwiched between two sheets, or a single sheet sandwiched by two coatings. The resultant composite renders the envelope substantially gas-impermeable and substantially air-tight. Experience has shown that flowers made with the above-described construction will remain sealed for an indefinite period of time in excess of about one year, with a potential maximum lifetime exceeding several years.

Other shapes for the panels are, of course, within the spirit of this invention. In fact, an unlimited number of shapes and configurations for the envelope is contemplated.

Each envelope is preferably inflated with air at atmospheric pressure, or slightly above atmospheric pressure.

Figure 6:
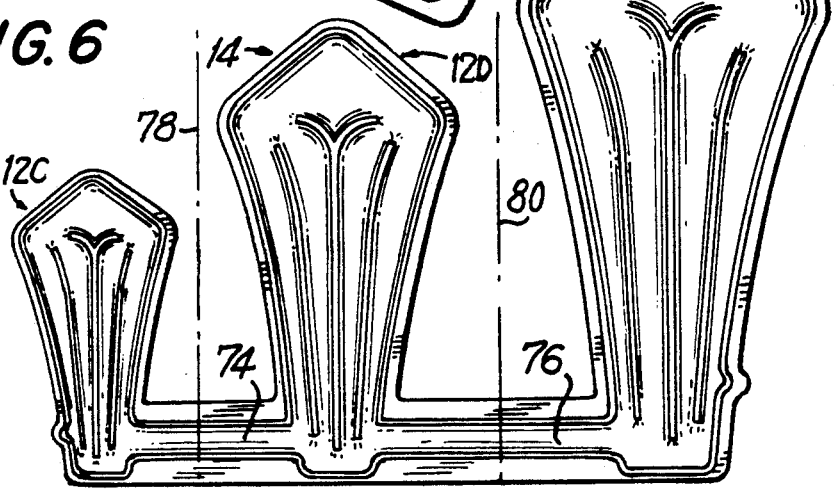
FIG. 6 is a front view of a modified inflated petal assembly in accordance with this invention.

Turning now to FIG. 6, another multiple petal assembly 14 includes three or more inflatable petals 12C, 12D, 12E. Rather than being mirror-symmetrical and of the same size, as described earlier for petals 12A, 12B, the petals 12C, 12D and 12E increase in size from one end to the other end of the assembly. Common conduits 74, 76 interconnect the adjacent petals. A fold line 78 is arranged between petals 12C, 12D, and another fold line 80 is arranged between petals 12D and 12E.

In use, the petal assembly is rolled, or folded up, with the smallest petal 12C being at the center of the flower of FIG. 1, and the largest petal 12E being at the exterior of the flower. More than three inflated petals are contemplated to form a full flower.

Figure 7:
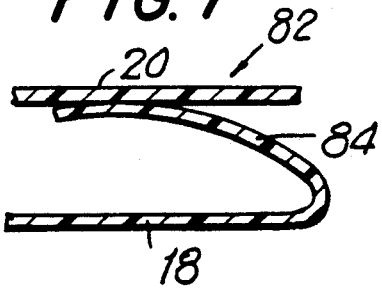
FIG. 7 is a broken-away sectional view of a self-closing valve at a filling nozzle for inflating the petal or petal assembly.

Turning now to FIG. 7, rather than heat-sealing the filling nozzle 26 shut after inflation, a self-closing check valve 82 can be used to seal the interior of each inflated petal or assembly. A flap 84 extends from one of the panels, e.g. panel 18, past the other panel 20, and is bent over to sealingly engage the interior surface of panel 20. A fill tube can be inserted between the flap 84 and the panel 20 to introduce gas into the petal or assembly. Withdrawal of the fill tube causes the flap to close and seal the gas within the petal or assembly.

It will be understood that each of the elements described above, or two or more together, also may find a useful application in other types of constructions differing from the types described above.

While the invention has been illustrated and described as embodied in an artificial flower with inflatable petals and/or inflatable multiple petal assemblies, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An inflatable, artificial petal, comprising:

(a) an elongated envelope extending along a longitudinal direction and having a periphery, said envelope including a pair of overlying panels sealed together along the periphery of the envelope and bounding an interior into which gas is introduced to inflate the petal, each panel having a neck portion and a head portion integral therewith, each head portion having a larger transverse dimension, as considered along a transverse direction generally perpendicular to the longitudinal direction, than the transverse dimension of the neck portion of the respective panel; and (b) means for sealing selected portions of the panels together within the periphery of the envelope along at least one elongated seam, said selected portions sealingly contacting each other along said at least one elongated seam, to impart a generally flattened shape to the inflated petal.

2. The artificial petal according to claim 1, wherein each panel is a non-elastomeric polymer sheet coated with a continuous metallic coating.

3. The artificial petal according to claim 1, wherein the gas is air at atmospheric pressure.

4. The artificial petal according to claim 1, wherein each neck and head portion of each panel has outwardly-flaring, longitudinally-extending side edges, the side edges of each neck portion merging continuously into the side edges of the head portion of the respective panel.

5. The artificial petal according to claim 1, wherein the sealing means seals the panels together along a plurality of elongated seams, each extending at least partially along the longitudinal direction, said seams being spaced apart along the transverse direction to form tubular channels within the interior of the envelope.

6. The artificial petal according to claim 5, wherein the tubular channels are in gaseous communication with one another.

7. The artificial petal according to claim 5, wherein the panels have rippled, outwardly-facing surfaces, and wherein the seams are located in a common plane midway between the rippled surfaces of the panels.

8. The artificial petal according to claim 5, wherein the seams extend at least partially along linear paths and at least partially along curved paths.

9. The artificial petal according to claim 5, wherein the envelope is foldable about each seam.

10. The artificial petal according to claim 1; and further comprising means for holding the petal in a gathered bunch of petals, said holding means including a shoulder portion on each panel, each shoulder portion having a larger transverse dimension than that of the neck portion of the respective panel.

11. The artificial petal according to claim 1, wherein the envelope has a self-closing filling inlet.

12. An artificial petal assembly, comprising:

(a) an envelope having a plurality of inflatable petals spaced apart of one another, each adjacent pair of petals being foldable relative to a fold line between the petals of each pair, said envelope including a periphery and a pair of overlying panels sealed together along the periphery, each panel of each petal having a neck portion and an enlarged head portion integral therewith, said panels of each petal together bounding an interior compartment into which gas is introduced for containment therein, each interior compartment being in gaseous communication with all the other interior compartments for inflating all of the petals; and (b) means for sealing selected portions of the panels together within the periphery of the envelope along at least one elongated seam, said selected portions sealingly contacting each other along said at least one elongated seam, to impart a generally flattened shape to each inflated petal.

13. The artificial petal assembly according to claim 12, wherein the petals are of the same size.

14. The artificial petal assembly according to claim 12, wherein the petals increase in size from one end of the envelope to an opposite end of the envelope.

15. The artificial petal assembly according to claim 12, wherein each panel is a non-elastomeric polymer sheet coated with a continuous metallic coating.

16. The artificial petal assembly according to claim 12, wherein the gas is air at atmospheric pressure.

17. The artificial petal assembly according to claim 12, wherein each neck and head portion of each panel has outwardly-flaring, longitudinally-extending side edges, the side edges of each neck portion merging continuously into the side edges of the head portion of the respective panel.

18. The artificial petal assembly according to claim 12, wherein the sealing means seals the panels of each petal together along a plurality of elongated seams, each extending at least partially along a longitudinal direction, said seams being spaced apart along a transverse direction generally perpendicular to the longitudinal direction to form tubular channels within the interior compartment of each petal.

19. The artificial petal assembly according to claim 18, wherein the tubular channels of each petal are in gaseous communication with one another.

20. The artificial petal assembly according to claim 18, wherein the panels of each petal have rippled, outwardly-facing surfaces, and wherein the seams are located in a common plane midway between the rippled surfaces of the panels of each petal.

21. The artificial petal assembly according to claim 18, wherein the seams extend at least partially along linear paths and at least partially along curved paths.

22. The artificial petal assembly according to claim 12, wherein the envelope includes a filling inlet.

23. The artificial petal assembly according to claim 12; and further comprising means for holding the petal assembly in a gathered bunch of petal assemblies, said holding means including a shoulder portion on each panel.

24. An artificial flower, comprising:

(a) an inflatable petal assembly including at least one envelope having a plurality of inflatable petals spaced apart of one another, each adjacent pair of petals being foldable relative to a fold line between the petals of each pair, said one envelope including a peripheral and a pair of overlying panels sealed together along the periphery, each panel of each petal having a neck portion and an enlarged head portion integral therewith, said panels of each petal together bounding an interior compartment into which gas is introduced for containment therein, each interior compartment being in gaseous communication with all the other interior compartments for inflating all of the petals;

(b) means for sealing selected portions of the panels together within the periphery of said one envelope along at least one elongated seam, said selected portions sealingly contacting each other along said at least one elongated seam, to impart a generally flattened shape to each inflated petal; and (c) means for gathering the folded petals at their respective neck portions in a corola-like configuration.

25. The artificial flower according to claim 24, wherein a plurality of said envelopes are gathered in a bunch by the gathering means.

26. The artificial flower according to claim 24; and further comprising a shoulder portion located on each envelope and engaging the gathering means to prevent relative displacement among the envelopes.

27. The artificial flower according to claim 24, wherein each panel of said one envelope is a nonelastomeric polymer sheet coated with a continuous metallic coating.

28. The artificial flower according to claim 24, wherein the gas is air at atmospheric pressure.

29. The artificial flower according to claim 24, wherein each neck and head portion of each panel has outwardly-flaring, longitudinally-extending side edges, the side edges of each neck portion merging continuously into the side edges of the head portion of the respective panel.

30. The artificial flower according to claim 24, wherein the sealing means seals the panels of each petal together along a plurality of elongated seams, each extending at least partially along a longitudinal direction, said seams being spaced apart along a transverse direction generally perpendicular to the longitudinal direction to form tubular channels within the interior compartment of each petal.

31. The artificial flower according to claim 30, wherein the tubular channels of each petal are in gaseous communication with one another.

32. The artificial flower according to claim 30, wherein the panels of each petal have rippled, outwardly-facing surfaces, and wherein the seams are located in a common plane midway between the rippled surfaces of the panels of each petal.

33. The artificial flower according to claim 30, wherein the seams extend at least partially along linear paths and at least partially along curved paths.

34. The artificial flower according to claim 24, wherein all the petals are of the same size.

35. The artificial flower according to claim 24, wherein all the petals increase in size from one end of the assembly to another end of the assembly.

36. The artificial flower according to claim 24, wherein the assembly includes a filling inlet.

37. A method of forming an artificial flower, comprising the steps of:

(a) forming an inflatable petal assembly with at least one envelope having a plurality of inflatable petals spaced apart of one another, each adjacent pair of petals being foldable relative to a fold line between the petals of each pair, said one envelope including a periphery and a pair of overlying panels sealed together along the periphery, each panel of each petal having a neck portion and an enlarged head portion integral therewith, said panels of each petal together bounding an interior compartment, each interior compartment being in gaseous communication with all the other interior compartments;

(b) introducing gas into the interior compartments to inflate the petals;

(c) sealing selected portions of the panels together within the periphery of said one envelope along at least one elongated seam, said selected portions sealingly contacting each other along said at least one elongated seam, to impart a generally flattened shape to each inflated petal;

(d) rolling the inflated petals into a roll, and folding the inflated petals about the fold lines; and (e) gathering the roll of inflated petals at their respective neck portions in a corola-like configuration.

* * * * *